US006000230A

United States Patent [19]

Kanno et al.

[11] Patent Number: 6,000,230

[45] Date of Patent: Dec. 14, 1999

[54] METHOD FOR DIVIDING AND CHARGING OF NON-AZEOTROPIC MIXED REFRIGERANT

[75] Inventors: Kiyomitsu Kanno, Tokyo; Toshio Haga, Kanagawa, both of Japan

[73] Assignee: Showa Denko K.K., Tokyo, Japan

[21] Appl. No.: 08/948,517

[22] Filed: Oct. 10, 1997

[30] Foreign Application Priority Data

Aug. 19, 1997 [JP] Japan ..... 9-222768

[51] Int. Cl.[6] ..... F25B 45/00

[52] U.S. Cl. ..... 62/77; 141/47; 141/5; 137/208; 137/209

[58] Field of Search ..... 62/77, 292, 149; 141/47, 2, 4, 5, 18, 21; 137/208, 209, 210

[56] References Cited

U.S. PATENT DOCUMENTS 4,905,719 3/1990 Lawless ..... 137/210

5,582,218 12/1996 Beale ..... 141/5

*Primary Examiner*—John M. Sollecito

*Attorney, Agent, or Firm*—Sughrue, Mion, Zinn, Macpeak & Seas, PLLC

[57] ABSTRACT

A method for dividing and charging of a non-azeotropic mixed refrigerant filled in at least one refrigerant tank, comprising:

a step of successively dividing and charging the non-azeotropic mixed refrigerant filled in the refrigerant tank into a plurality of receivers while maintaining a vapor phase or a liquid phase of the refrigerant in the refrigerant tank in communication with a vapor phase of an adjustor refrigerant in at least one adjustor refrigerant container filled with the adjustor refrigerant having a composition substantially equivalent to that of the non-azeotropic mixed refrigerant.

9 Claims, 3 Drawing Sheets

METHOD FOR DIVIDING AND CHARGING OF NON-AZEOTROPIC MIXED REFRIGERANT

BACKGROUND OF THE INVENTION

1. Field of the Invention

The present invention relates to a method for dividing and charging of non-azeotropic mixed refrigerant, by which on the occasion of successively dividing and charging a non-azeotropic mixed refrigerant filled in a refrigerant tank into a plurality of receivers, compositions of divided portions of the refrigerant are prevented from differing receiver from receiver.

2. Related Background Art

Conventional refrigerants for air-conditioning and refrigerating machines popularly used were those of single-component composition such as dichlorodifluoromethane (alias CFC12; note that aliases will also be used hereinafter) or chlorodifluoromethane (HCFC22). In recent years, however, depletion of the stratosphere's ozone layer due to chlorofluorocarbons (CFCs) was posed as a serious environmental problem and production thereof was stopped at the end of 1995. For the existing air-conditioning and refrigerating machines using the CFCs, mixed refrigerants comprised of a plurality of hydrochlorofluorocarbons (HCFCs), hydrofluorocarbons (HFCs), fluorocarbons (FCs), hydrocarbons (HCs) or the like with adjusted physical properties and cooling performance were developed as alternatives or refills.

Further, the above-stated HCFCs have smaller effects on the depletion of the ozone layer than the CFCs, but, because of a high possibility of increase in amounts of use as alternatives to the CFCs, abolition of use of HCFCs in the year of 2020 was determined as a general rule and the international regulation of total quantity has been started since 1996. Refrigerants under research are thus those using HFC components with ozone depleting potential of zero that are not materials subject to the regulation, particularly as alternatives to HCFC 22 widely used for the air-conditioning machines and the like.

Since there is no single-component refrigerant capable of being used in the conventional machines for HCFC22 in place thereof as it is, HFC-based mixed refrigerants of two component system or three or more component system the physical properties of which were adjusted by mixing a plurality of components have been developed as refrigerant compositions capable of replacing HCFC22. From the same point of view, a variety of mixed refrigerants were proposed, for example, mixed refrigerants of plural HCs, mixed refrigerants of a HC with a HFC, and mixed refrigerants containing a hydrofluoroether (HFE) or a fluoroether (FE).

The most of these mixed refrigerants, however, are non-azeotropic mixed refrigerants, different from the single-component refrigerants such as CFC12 or HCFC22 and the azeotropic mixed refrigerants such as alias R502 having been used heretofore as low-temperature refrigerants. With such non-azeotropic mixed refrigerants, there was a problem that in successively dividing and charging the non-azeotropic mixed refrigerant from the refrigerant tank into a plurality of receivers, compositions of the respective receivers differed from the composition of original refrigerant (the original composition).

If the composition of refrigerant varied over the permissible limit in a receiver divisionally charged, the cooling performance and the other performance of air-conditioning or refrigerating machine would change out of utilization. In practice, the variation of composition becomes greater as an amount of residual refrigerant decreases in the refrigerant tank. In many cases, the residual refrigerant, for example after the draw of about 80% from the refrigerant tank, is thus not used for dividing and charging from the reason of the permissible limit of composition and it is returned to a charging factory as it is. The residual refrigerant returned to the charging factory, however, requires a lot of cost and time for recovery and recycling processes of refrigerant of varied composition, which is a cause of increase in the cost of refrigerant product.

As means for solving the problem of variation in the composition of liquid phase upon dividing and charging of non-azeotropic mixed refrigerant, for example, the bulletin of Japanese Laid-open Patent Application No. Hei 8-157810 and the International Laying-open Publication of WO 96/33377 present methods for preliminarily adjusting the composition of the refrigerant charged in the refrigerant tank so as to make a low-boiling-point component excessive. These methods are not, however, completely free of the variation of composition among the receivers depending upon the volume of the refrigerant tank, the quantity of draw, the number of dividing and charging processes, and so on.

SUMMARY OF THE INVENTION

The inventors found that the following point was the cause to raise the above problem in the conventional technology and conducted extensive and intensive research to solve the problem, thereby accomplishing the present invention as a consequence.

In the above non-azeotropic mixed refrigerants a concentration of low-boiling-point component therein in the vapor phase is higher than that in the liquid phase because of the vapor-liquid equilibrium relation. As the volume of the liquid phase decreases in the refrigerant tank of a constant volume because of the draw for dividing and charging, the volume of the vapor phase thus increases therewith and the low-boiling-point component moves into the vapor phase. This causes the concentration of the low-boiling-point component in the refrigerant (the liquid phase) to be progressively decreased, thereby posing the aforementioned problem in the conventional technology.

An object of the present invention is thus to provide a method for dividing and charging of non-azeotropic mixed refrigerant by which on the occasion of successively dividing and charging the non-azeotropic mixed refrigerant filled in the refrigerant tank into plural receivers, compositions of divided portions of the refrigerant are prevented from differing receiver from receiver.

The present invention provides a method for dividing and charging of a non-azeotropic mixed refrigerant filled in at least one refrigerant tank, comprising:

a step of successively dividing and charging the non-azeotropic mixed refrigerant filled in said refrigerant tank into a plurality of receivers while maintaining a vapor phase or a liquid phase of the refrigerant in said refrigerant tank in communication with a vapor phase of an adjustor refrigerant in at least one adjustor refrigerant container filled with the adjustor refrigerant having a composition substantially equivalent to a composition of the non-azeotropic mixed refrigerant.

In the above method of the present invention, the total weight of said adjustor refrigerant is preferably equal to or greater than the total weight of the refrigerant in said refrigerant tank. In addition, the composition of said adjustor refrigerant is preferably within a range of ±2% by weight with respect to the composition of the non-azeotropic mixed refrigerant filled in said refrigerant tank.

The refrigerant in said refrigerant tank is preferably a non-azeotropic mixed refrigerant containing two or more selected from the group consisting of HCFCS, HFCs, HCs, FCs, HFEs, FEs, and fluoroiodocarbons (FICs). Particularly, the refrigerant in said refrigerant tank is preferably a non-azeotropic mixed refrigerant containing two or more selected from the group consisting of difluoromethane (HFC32), pentafluoroethane (HFC125), and 1,1,1,2-tetrafluoroethane (HFC134a).

The above method of the present invention may further comprise:

- a step of preparing the refrigerant tank filled with said non-azeotropic mixed refrigerant;
- a step of preparing the adjustor refrigerant container filled with said adjustor refrigerant; and
- a step of connecting said refrigerant tank with said adjustor refrigerant container through a conducting pipe, thereby maintaining the vapor phase of the adjustor refrigerant in said adjustor refrigerant container in communication with the vapor phase or the liquid phase of the non-azeotropic mixed refrigerant in said refrigerant tank.

In the step of dividing and charging said non-azeotropic mixed refrigerant, the vapor phase of said adjustor refrigerant can be maintained in a state of being capable of being introduced into the vapor phase or into the liquid phase of the non-azeotropic mixed refrigerant with progress of discharge of the refrigerant in said refrigerant tank. In the same step, preferably, a temperature of said adjustor refrigerant is maintained within a range of between a temperature of the non-azeotropic mixed refrigerant in the refrigerant tank and said temperature +5° C., and a change in a temperature of the non-azeotropic mixed refrigerant in said refrigerant tank is maintained within a range of an initial temperature thereof ±10° C.

In the present specification, "refrigerant" means the liquid phase thereof unless otherwise stated. Further, "composition" represents a weight ratio of components forming the refrigerant (the liquid phase).

DESCRIPTION OF THE PREFERRED EMBODIMENTS

The embodiments of the present invention will be described by reference to the drawings. It is, however, noted that the present invention is by no means intended to be limited to the embodiments described below.

Figure 1:
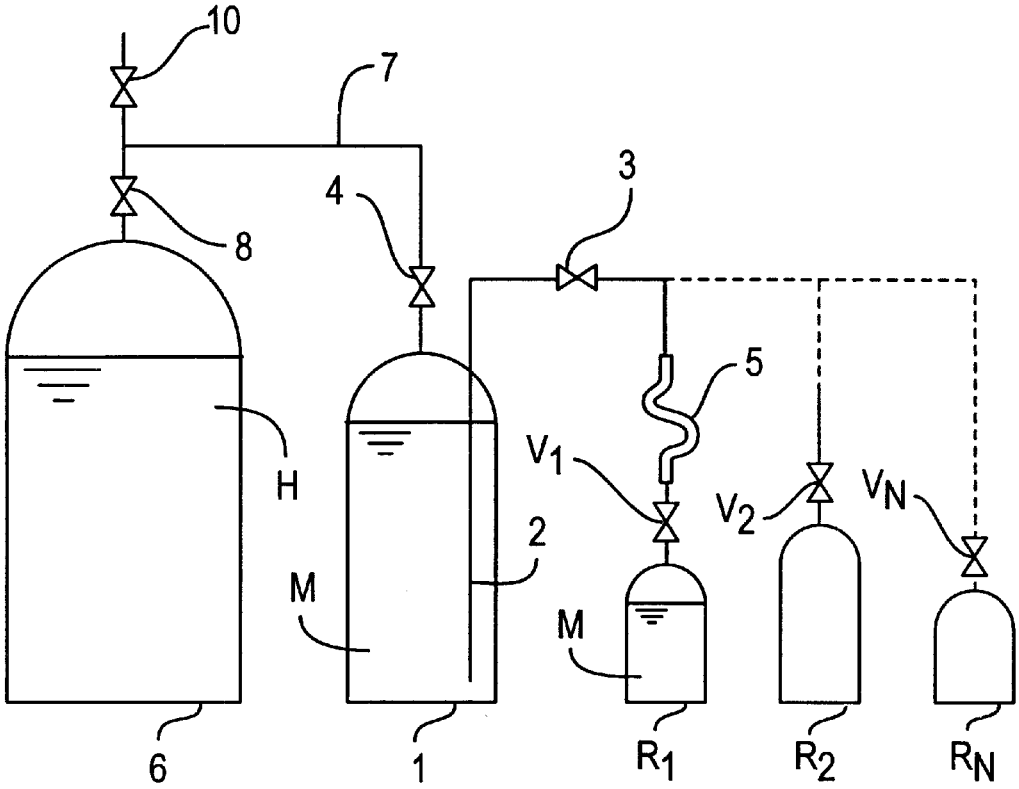
FIG. 1 is a schematic diagram to show an embodiment of apparatus for carrying out the method of the present invention.

FIG. 1 shows an embodiment of apparatus for carrying out the method for dividing and charging of non-azeotropic mixed refrigerant according to the present invention. In FIG. 1 reference numeral 1 designates a refrigerant tank. This refrigerant tank 1 is filled with a predetermined amount of a non-azeotropic mixed refrigerant (hereinafter referred to simply as "refrigerant") M having a predetermined composition $S_0$. This refrigerant tank 1 has a liquid draw pipe 2 one end of which is located adjacent to the bottom of the tank. Through this liquid draw pipe 2 and a liquid valve 3 provided in an external extension thereof, the refrigerant M can be drawn into receivers $R_1, R_2, \ldots, R_n$ for dividing and charging. A vapor valve 4 is attached to a conducting pipe extending from the top of the refrigerant tank 1.

Each receiver $R_1, R_2, \ldots, R_n$ has a volume that can be determined arbitrarily and has an inlet valve $V_1, V_2, \ldots, V_n$ for receiving the refrigerant m of divided and charged portion. Either one of these inlet valves is connected to the liquid valve 3 of the refrigerant tank 1 through a flexible hose 5 or the like, whereby a corresponding amount of divided refrigerant m is charged into the receiver. FIG. 1 shows a state wherein the receiver $R_1$ is connected to the refrigerant tank 1.

In the present embodiment, another container (adjustor refrigerant container) 6 is filled with a refrigerant for adjustment (adjustor refrigerant) H having a composition substantially equivalent to the composition $S_0$ of the refrigerant M in the refrigerant tank 1, and the vapor valve 4 of the refrigerant tank 1 is connected through a conducting pipe 7 to a vapor valve 8 attached to a conducting pipe from the top of this adjustor refrigerant container 6. When the vapor valve 8 and vapor valve 4 are opened in this state, the vapor phase of the refrigerant M in the refrigerant tank 1 becomes communicating with the vapor phase of the adjustor refrigerant H. The composition of the adjustor refrigerant H does not have to be perfectly equal to the composition $S_0$ of the refrigerant M in the refrigerant tank 1, but is preferably within the range of composition $S_0$±2% by weight and particularly preferably within the range of composition $S_0$±1% by weight.

When this connected system becomes stable at a substantially constant temperature (preferably at room temperature), the liquid valve 3 and inlet valve $V_1$ are opened, whereupon the refrigerant (the liquid phase) M is pushed out by the internal pressure of the vapor phase in the refrigerant tank 1 to be guided successively via the liquid draw pipe 2, liquid valve 3, flexible hose 5, and inlet valve $V_1$ and to be charged into the receiver $R_1$ by a predetermined amount of refrigerant m.

If the communication between the refrigerant tank 1 and the adjustor refrigerant container 6 were interrupted at this time, the amount of the liquid phase would decrease and the volume of the vapor phase would increase in the refrigerant tank 1, which would cause the change of composition so as to decrease the concentration of the low-boiling-point component in the refrigerant (the liquid phase). If dividing and charging were continued as successively switching the receivers from the receiver $R_1$, for example, to the receivers $R_2, \ldots, R_n$, compositions $S_2, \ldots, S_n$ of the refrigerant portions filling these receivers would vary from the original composition $S_0$. In the case of the present invention wherein the vapor phases of the refrigerant tank 1 and the adjustor refrigerant container 6 are in communication with each other, the vapor-liquid equilibrium relation in the adjustor refrigerant container 6 is equal to that in the refrigerant tank 1, so that the composition of the refrigerant M remaining in the refrigerant tank 1 can be maintained approximately at the original composition $S_0$. Therefore, when the dividing and charging is repeated while successively switching the receivers $R_1, R_2, \ldots, R_n$, the compositions of refrigerant portions filling the respective receivers $R_1, R_2, \ldots, R_n$ are substantially equal to the original composition $S_0$ within the permissible range of ±1% by weight, preferably of ±0.5% by weight, regardless of the volumes and the charging order of those receivers.

In the aforementioned embodiment, when the total weight of the adjustor refrigerant H is equal to or greater than the total weight of the refrigerant M charged in the refrigerant tank 1, the low-boiling-point component tends to be quickly supplied from the adjustor refrigerant H via the vapor phase to the refrigerant M in any stage of dividing and charging, so that quick dividing and charging can be performed while maintaining the composition of refrigerant m in each receiver approximately at the original composition $S_0$ within the aforementioned permissible range.

Although the above embodiment of the present invention shown in FIG. 1 has only one adjustor refrigerant container 6, the number thereof is not always limited to one. The method may also be carried out in a state of connection of vapor phases of refrigerants in plural adjustor refrigerant containers through respective conducting pipes and amounts of the refrigerants in the respective containers do not always have to be equal. In this case, the total weight of the refrigerants in these adjustor refrigerant containers is preferably equal to or greater than the weight of the refrigerant M charged in the refrigerant tank 1. In the same fashion, it is also possible to arrange a plurality of refrigerant tanks in communication with vapor phases of refrigerants in plural adjustor refrigerant containers and perform simultaneous and parallel dividing and charging from these refrigerant tanks. At this time the total weight of the refrigerants in these adjustor refrigerant containers is preferably equal to or greater than the total weight of the refrigerants charged in the plural refrigerant tanks.

The method of the present invention permits the refrigerant M to be successively divided and charged into the plural receivers while maintaining the compositions close to the original composition $S_0$ until the remaining amount of the refrigerant M in the refrigerant tank 1 has reached the draw limit (the limit at which the liquid phase disappears because of the characteristics of refrigerant). Therefore, the method of the present invention is economical.

The constituent elements of the present invention will be described in detail.

The refrigerant suitable for the dividing and charging method of the present invention is preferably a non-azeotropic mixed refrigerant containing two or more selected from the group consisting of HCFCs, HFCs, HCs, FCs, HFEs, FEs, and FICs. Among these, specific examples of HCFCs include HCFC22 ($CHClF_2$), HCFC123 ($CHCl_2$—$CF_3$), HCFC124 ($CHClF$—$CF_3$), HCFC141b ($CH_3$—$CCl_2F$), HCFC142b ($CH_3$—$CClF_2$), HCFC225ca ($CHCl_2$—$CF_2$—$CF_3$), HCFC225cb ($CHClF$—$CF_2$—$CClF_2$), and so on.

Specific examples of HFCs include HFC23 ($CHF_3$), HFC32 ($CH_2F_2$), HFC41 ($CH_3F$), HFC134 ($CHF_2$—$CHF_2$), HFC134a ($CH_2F$—$CF_3$), HFC143a ($CH_3$—$CF_3$), HFC125 ($CHF_2$—$CF_3$), HFC161 ($CH_3$—$CH_2F$), HFC227ea ($CF_3$—$CHF$—$CF_3$), HFC227ca ($CHF_2$—$CF_2$—$CF_3$), HFC236ca ($CHF_2$—$CF_2$—$CHF_2$), HFC236cb ($CH_2F$—$CF_2$—$CF_3$), HFC236ea ($CHF_2$—$CHF$—$CF_3$), HFC236fa ($CF_3$—$CH_2$—$CF_3$), HFC245ca ($CH_2F$—$CF_2$—$CHF_2$), HFC245cb ($CH_3$—$CF_2$—$CF_3$), HFC245fa ($CHF_2$—$CH_2$—$CF_3$), HFC254cb ($CH_3$—$CF_2$—$CHF_2$), and so on.

Specific examples of HCs include HC290 ($CH_3$—$CH_2$—$CH_3$), HC600 ($CH_3$—$CH_2$—$CH_2$—$CH_3$), HC600a ($(CH_3)_2CH$—$CH_3$), HC601 ($CH_3$—$CH_2$—$CH_2$—$CH_2$—$CH_3$), HC601a ($(CH_3)_2CH$—$CH_2$—$CH_3$), HC601b ($(CH_3)_4C$), HC170 ($CH_3$—$CH_3$), HC-C270 (cyclic —$CH_2$—$CH_2$—$CH_2$—), HC1270 ($CH_3$—$CH$=$CH_2$), and so on.

Specific examples of FCs include FC218 ($CF_3$—$CF_2$—$CF_3$), FC—C318 (cyclic —$C_4F_8$—), and so on.

Specific examples of HFEs and FEs include HFE134 ($CHF_2$—O—$CHF_2$), HFE143a ($CH_3$—O—$CF_3$), HFE125 ($CHF_2$—O—$CF_3$), HFE227ca2 ($CHF_2$—$CF_2$—O—$CF_3$), HFE245cb2 ($CH_3$—$CF_2$—O—$CF_3$), HFE—C318 (cyclic —$CF_2$—$CF_2$—$CF_2$—O—$CF_2$—), FE116 ($CF_3$—O—$CF_3$), and so on.

Specific examples of FICs include FIC13I1 ($CF_3I$), FIC115I1 ($CF_3$—$CF_2I$), and so on.

Particularly, the dividing and charging method of the present invention can be effectively applied to dividing and charging of the conventionally known non-azeotropic mixed refrigerants. Examples of these non-azeotropic mixed refrigerants are listed below with their aliases and components and standard compositions thereof (% by weight).

R403B:HC290/HCFC22/FC218=5/56/39

R407C:HFC32/HFC125/HFC134a=23/25/52

R407E:HFC32/HFC125/HFC134a=25/15/60

R900JA:HFC32/HFC134a=30/70

Among the above conventionally known non-azeotropic mixed refrigerants, particularly, R407C is promising as an alternative refrigerant to HCFC22. Now described below is an application example of the present invention for dividing and charging this R407C.

In FIG. 1, the refrigerant tank 1 is charged with 20 kg of refrigerant R407C and the vapor valves 4, 8 are opened to make the refrigerant tank 1 communicate with the vapor phase of the adjustor refrigerant container 6. In this state the refrigerant is drawn from the refrigerant tank 1 through the liquid draw pipe 2 to be successively divided and charged into the plural receivers $R_1, R_2, \ldots, R_n$ by the refrigerant m of 0.5 kg each up to the draw limit of the refrigerant tank 1. Then samples of refrigerants m charged in the respective receivers are sampled to analyze compositions thereof by gas chromatography and changes of composition of HFC32 (standard boiling point: −51.7° C.) and HFC125 (standard boiling point: −48.5° C.) in the liquid phase of receiver are obtained against liquid-phase draw percentage from the refrigerant tank 1. The results shown in FIG. 3 are obtained.

Figure 3:
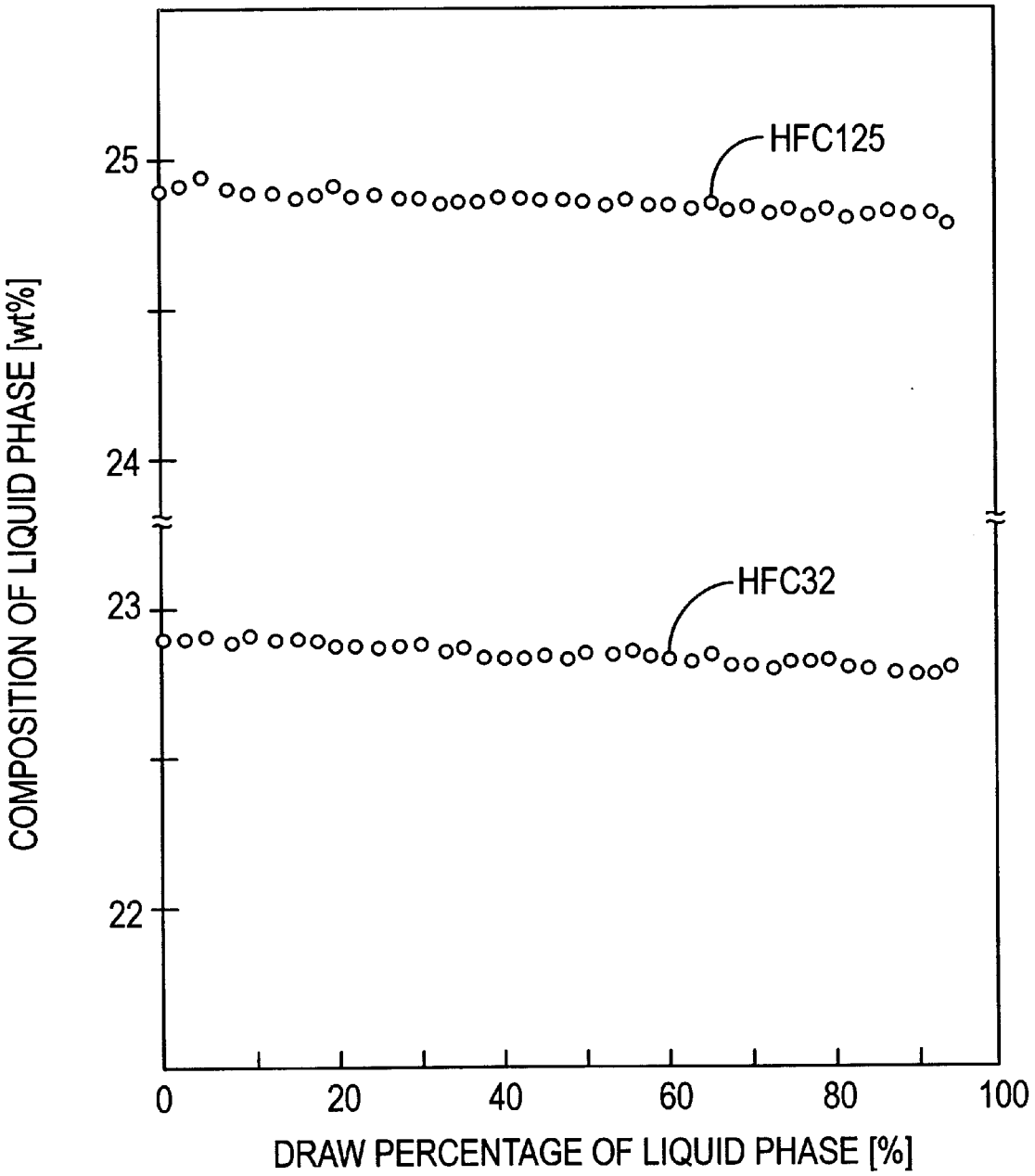
FIG. 3 is a graph to show the relationship between liquid-phase draw percentage and composition of liquid phase in an example of the present invention.

It is understood from FIG. 3 that the compositions of refrigerant can be maintained with little change up to the draw limit of dividing and charging by the method of the present invention to keep the refrigerant tank 1 in communication with the vapor phase of the adjustor refrigerant H.

In contrast to it, the vapor valve 4 in FIG. 1 is closed to interrupt the communication between the refrigerant tank 1 and the adjustor refrigerant container 6, the refrigerant is divided and charged in the same manner as above from the refrigerant tank 1 into the plural receivers $R_1, R_2, \ldots, R_n$ by the refrigerant m of 0.5 kg each, the refrigerants of the respective receivers are analyzed, and changes of composition of HFC32 and HFC125 in the liquid phase of receiver are obtained against liquid-phase draw percentage from the refrigerant tank 1 for the case not using the adjustor refrigerant H. The results shown in FIG. 4 are obtained.

Figure 4:
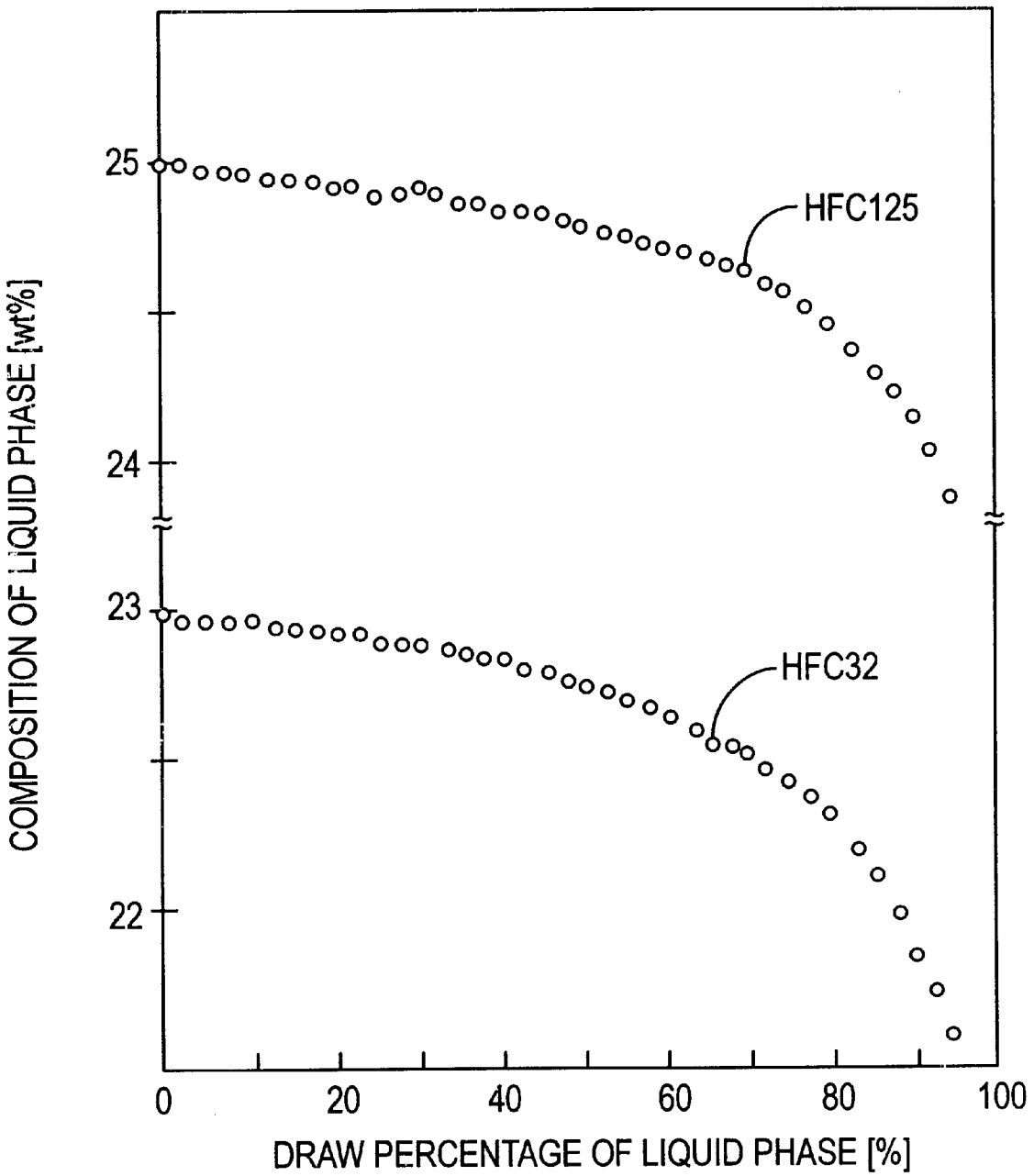
FIG. 4 is a graph to show the relationship between liquid-phase draw percentage and composition of liquid phase in a comparative example.

It is seen from FIG. 4 that without, use of the adjustor refrigerant H, concentrations of HFC32 and HFC125 in the liquid phases of the receivers $R_1, R_2, \ldots, R_n$ progressively decrease with increase of draw percentage of liquid phase while concentrations of HFC134a (standard boiling point: −26.5° C.) relatively increase and particularly that the composition changes become great when the draw percentage is 70% to 80% or more.

In practice, when the refrigerant is successively divided and charged from the refrigerant tank into plural refrigerant tanks of refrigerating or air-conditioning machine by predetermined amounts of refrigerant by the conventional method without use of the adjustor refrigerant H, composition changes are unavoidable among machines as a result. In order to maintain the performance of machine within the control limit, the draw must be stopped when the draw percentage reaches a certain drawing limit. Normally, if the draw is stopped at the liquid-phase drawing percentage, for example, of about 70% to 80% at room temperature, composition changes of HFC32 and HFC125 can be controlled within approximately −0.5% by weight of the original composition. The composition changes of −0.5% by weight of HFC32 and HFC125 will cause a relative composition change of +1% by weight of HFC134a, so that the composition change of each component can be maintained within ±1% by weight of the original composition. This is considered to be within an allowable range also in terms of the performance of refrigerating and air-conditioning machines.

Accordingly, when the non-azeotropic mixed refrigerant comprised of HFC32, HFC125, and HFC134a is used, the method of the present invention is effectively applied especially to the residual refrigerant of 20% to 30% remaining after the initial draw.

In the method of the present invention, since upon making the refrigerant M in the refrigerant tank 1 communicate with the vapor phase of the adjustor refrigerant H, the composition of refrigerant M varies so as to approach the composition of either refrigerant of greater amount, the total weight of the adjustor refrigerant H as a composition adjusting source is preferably equal to or greater than the total weight of the refrigerant M. Further, in order to maintain the composition of refrigerant M constant with more certainty up to the draw limit, the total weight of the adjustor refrigerant H is more preferably two or more times greater than the total weight of the refrigerant M. Since the method of the present invention is particularly effective to the residual refrigerant of 20% to 30% remaining after the initial draw as described above, the adjustor refrigerant H two or more times greater by weight than the residual refrigerant will suffice in practice. Accordingly, the method of the present invention will also be effective even if the total weight of the adjustor refrigerant H is, for example, approximately a half of the initial total weight of the refrigerant M in the refrigerant tank 1.

In the method of the present invention, after all, the low-boiling-point component contained in the vapor phase of the adjustor refrigerant H makes up for the decrease of concentration of low-boiling-point component occurring with dividing and charging of the refrigerant M in the refrigerant tank. The arrangement may thus be modified as shown in FIG. 2, wherein the end of conducting pipe 27 on the refrigerant tank 21 side to connect the adjustor refrigerant container 26 with the refrigerant tank 21 is extended as an extension pipe 29 up to the vicinity of the bottom part of the refrigerant tank 21 via the vapor valve 24 so that the vapor phase of the adjustor refrigerant H may be in direct contact with the liquid phase of the refrigerant M.

Figure 2:
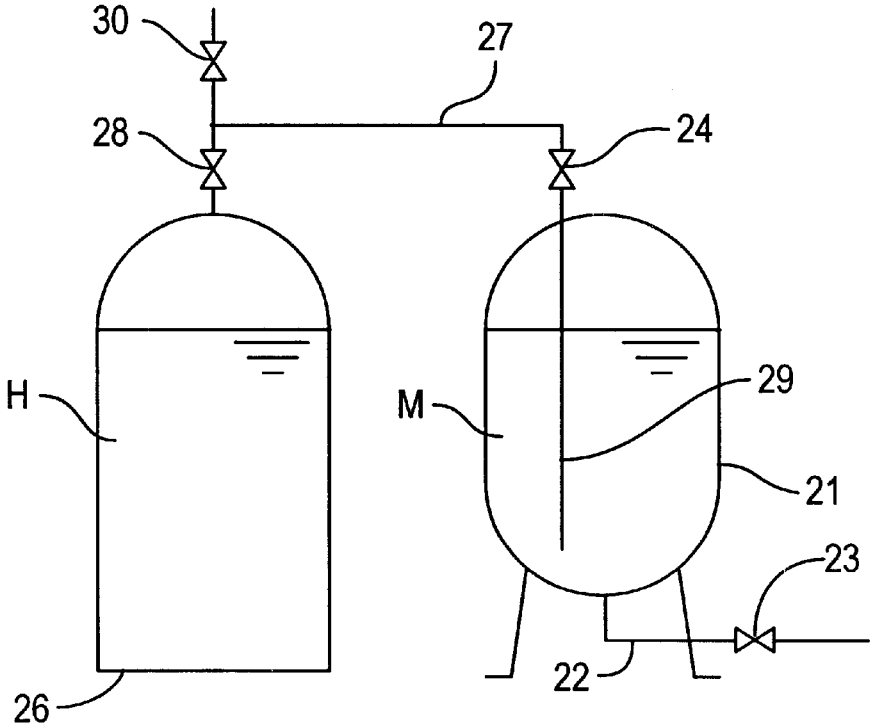
FIG. 2 is a schematic diagram to show another embodiment of apparatus for carrying out the method of the present invention.

In either method of FIG. 1 and FIG. 2, the vapor-liquid equilibrium relations inside the refrigerant tank and inside the adjustor refrigerant container need to be equal and the tank and container are thus preferably placed under an identical temperature. This temperature can be set arbitrarily, but temperatures of not less than 40° C. are not preferred in general, because increase of internal pressure could make the system subject to the regulations for high-pressure gas. Normally, the dividing and charging operation is carried out preferably while maintaining the refrigerant tank and adjustor refrigerant container at room temperature of below 40° C. The temperature of the adjustor refrigerant container (the adjustor refrigerant) is preferably controlled within the range of the temperature of the refrigerant tank (non-azeotropic mixed refrigerant) +0° C. to +5° C. Since the temperatures during the dividing and charging operation are desired to be constant, temperature changes during the operation are preferably to be controlled within the initial temperature ±10° C.

The containers in applications of the method of the present invention, including the refrigerant tank, the adjustor refrigerant container, and the receivers ($R_1$, $R_2$, . . . , $R_n$), are not limited to specific volumes or shapes. The containers may be either of cans of thin metal sheet called service cans, containers for movement such as bombs, tank lorries, or ISO tank containers, or fixed refrigerant containers such as refrigerant tanks attached to the refrigerating and air-conditioning machines or product tanks, for example. The refrigerant tank and the adjustor refrigerant container may be of the same type or of different types.

The method of the present invention can maintain the composition of residual refrigerant almost constant without change after a partial draw of the liquid phase for dividing and charging from the refrigerant tank. Therefore, it can maintain the composition of refrigerant substantially constant before the refrigerant tank becomes vacant in the dividing and charging operation.

Examples of the present invention and comparative examples will be described. In the examples and comparative examples, composition percentages are expressed all by % by weight.

EXAMPLE 1

In FIG. 1, the refrigerant tank 1 was filled with 20 kg of the non-azeotropic mixed refrigerant R407C. Sampling the refrigerant in the refrigerant tank 1 through the liquid draw pipe 2, the composition thereof was measured by gas chromatography and the composition was verified to be as follows.

HFC32/HFC125/HFC134a=22.9/24.9/52.2

Separately, the adjustor refrigerant container 6 was filled with 20 kg of the same refrigerant R407C as above to be used as the adjustor refrigerant H. The composition of this adjustor refrigerant H was as follows.

HFC32/HFC125/HFC134a=23.3/25.2/51.2

It was thus verified that the composition of the adjustor refrigerant H was within the range of ±1% by weight with respect to the composition of the refrigerant in the refrigerant tank 1.

Next, as shown in FIG. 1, the top of the refrigerant tank 1 was connected through the conducting pipe 7 to the top of the adjustor refrigerant container 6 and the inside of the conducting pipe 7 was evacuated with the vapor valves 4, 8 at the top of the respective containers being closed and with an exhaust valve 10 of a side pipe being opened. After the evacuation, the exhaust valve 10 was closed and the vapor valves 4, 8 were opened to bring the vapor phase portions of the both containers into communication with each other. In this state the refrigerant was drawn through the liquid draw pipe 2 of the refrigerant tank 1, the liquid valve 3, and the flexible hose 5 to successively charge the plurality of receivers $R_1$, $R_2$, . . . , $R_n$ for dividing and charging by 0.5 kg refrigerant each.

The liquid phases were sampled from the respective receivers $R_1$, $R_2$, . . . , $R_n$ for dividing and charging and compositions of the respective samples were analyzed. The results shown in FIG. 3 were obtained. Specifically, drops of concentrations of the low-boiling-point components of HFC32 and HFC125 were approximately 0.1% by weight up to the liquid-phase draw percentage of about 95% which was the draw limit of the refrigerant tank 1; R407C was able to be charged in the plurality of receivers for dividing and charging within the permissible range of ±1% by weight with respect to the original component of the refrigerant in the refrigerant tank 1.

After the end of the above dividing and charging operation, the refrigerant in the adjustor refrigerant container 6 was sampled and analyzed. The composition of the refrigerant in the adjustor refrigerant container 6 was as follows.

HFC32/HFC125/HFC134a=23.1/25.0/51.9

It was thus confirmed that the composition was nearly equivalent to the original composition of the refrigerant in the refrigerant tank 1. Therefore, this adjustor refrigerant container 6 was able to be reused as a refrigerant tank 1 in the next dividing and charging operation as it was.

Comparative Example 1

The same method as in Example 1 was repeated except that the vapor valve 4 at the top of the refrigerant tank 1 was closed to interrupt the communication between the vapor phase of the refrigerant tank 1 and the vapor phase of the adjustor refrigerant container 6. The composition of the initial refrigerant M in the refrigerant tank 1 was verified to be as follows.

HFC32/HFC125/HFC134a=23.1/25.0/51.9

The liquid phases were sampled from the respective receivers for dividing and charging $R_1$, $R_2$, . . . , $R_n$ and compositions thereof were analyzed, obtaining the results shown in FIG. 4. As a result of the dividing and charging operation, the composition was as follows of the refrigerant in the receiver divisionally charged near the liquid-phase draw percentage 95% being the draw limit of the refrigerant tank 1.

HFC32/HFC125/HFC134a=21.6/23.9/54.5

The composition thus varied over the permissible range of ±1% by weight with respect to the original composition of the refrigerant in the refrigerant tank 1.

EXAMPLE 2

In FIG. 1, the refrigerant tank 1 was filled with 20 kg of the non-azeotropic mixed refrigerant R407E. Sampling the refrigerant in the refrigerant tank 1 through the liquid draw pipe 2, the composition thereof was measured by gas chromatography and the composition was verified to be as follows.

HFC32/HFC125/HFC134a=25.1/14.9/60

Separately, the adjustor refrigerant container 6 was filled with 10 kg of the same refrigerant R407E as above to be used as the adjustor refrigerant H. The weight of this adjustor refrigerant H was a half of the weight of the refrigerant M in the refrigerant tank 1. The composition of this adjustor refrigerant H was as follows.

HFC32/HFC125/HFC134a=25.2/15.4/59.4

It was thus verified that the composition of the adjustor refrigerant H was within the range of ±1% by weight with respect to the composition of the refrigerant in the refrigerant tank 1.

Next, as shown in FIG. 1, the top of the refrigerant tank 1 was connected through the conducting pipe 7 to the top of the adjustor refrigerant container 6 and the inside of the conducting pipe 7 was evacuated with the vapor valves 4, 8 at the top of the respective containers being closed and with the exhaust valve 10 of the side pipe being opened. After the evacuation, the exhaust valve 10 was closed and the vapor valves 4, 8 were opened to bring the vapor phase portions of the both containers into communication with each other. In this state the refrigerant was drawn through the liquid draw pipe 2 of the refrigerant tank 1, the liquid valve 3, and the flexible hose 5 to successively charge the plurality of receivers $R_1$, $R_2$, . . . , $R_n$ for dividing and charging by 0.5 kg refrigerant each.

The liquid phases were sampled from the respective receivers $R_1$, $R_2$, . . . , $R_n$ for dividing and charging and compositions of the respective samples were analyzed. The results showed almost equivalent compositions for the all receivers, and with the refrigerant in the receiver divisionally charged near the liquid-phase draw percentage 95% being the draw limit of the refrigerant tank 1, the composition thereof was within the permissible range of ±1% by weight with respect to the original composition of the refrigerant in the refrigerant tank 1.

Comparative Example 2

The same method as in Example 2 was repeated except that the vapor valve 4 at the top of the refrigerant tank 1 was closed to interrupt the communication between the vapor phase of the refrigerant tank 1 and the vapor phase of the adjustor refrigerant container 6. The composition of the initial refrigerant M in the refrigerant tank 1 was verified to be as follows.

HFC32/HFC125/HFC134a=24.9/15.1/60

As a result of the dividing and charging operation, the composition was as follows of the refrigerant in the receiver divisionally charged near the liquid-phase draw percentage 95% being the draw limit of the refrigerant tank 1.

HFC32/HFC125/HFC134a=22.4/14.0/63.6

The composition thus varied over the permissible range of ±1% by weight with respect to the original composition of the refrigerant in the refrigerant tank 1.

EXAMPLE 3

In FIG. 1, the refrigerant tank 1 was filled with 20 kg of the non-azeotropic mixed refrigerant R900JA. Sampling the refrigerant in the refrigerant tank 1 through the liquid draw pipe 2, the composition thereof was measured by gas chromatography and the composition was verified to be as follows.

HFC32/HFC134a=29.9/70.1

Separately, the adjustor refrigerant container 6 was filled with 40 kg of the refrigerant R900JA to be used as the adjustor refrigerant H. The weight of this adjustor refrigerant H was the double of the weight of the refrigerant M charged in the refrigerant tank 1. The composition of this adjustor refrigerant H was as follows.

HFC32/HFC134a=31.4/68.6

It was thus verified that the composition of the adjustor refrigerant H was within the range of ±2% by weight with respect to the composition of the refrigerant in the refrigerant tank 1.

Next, as shown in FIG. 1, the top of the refrigerant tank 1 was connected through the conducting pipe 7 to the top of the adjustor refrigerant container 6 and the inside of the conducting pipe 7 was evacuated with the vapor valves 4, 8 at the top of the respective containers being closed and with the exhaust valve 10 of the side pipe being opened. After the evacuation, the exhaust valve 10 was closed and the vapor valves 4, 8 were opened to bring the vapor phase portions of the both containers into communication with each other. In this state the refrigerant was drawn through the liquid draw pipe 2 of the refrigerant tank 1, the liquid valve 3, and the flexible hose 5 to successively charge the plurality of receivers $R_1$, $R_2$, . . . , $R_n$ for dividing and charging by 0.5 kg refrigerant each.

The liquid phases were sampled from the respective receivers $R_1$, $R_2$, . . . , $R_n$ for dividing and charging and compositions of the respective samples were analyzed. The results showed almost equivalent compositions for the all receivers, and with the refrigerant in the receiver divisionally charged near the liquid-phase draw percentage 95% being the draw limit of the refrigerant tank 1, the composition thereof was within the permissible range of ±1% by weight with respect to the original composition of the refrigerant in the refrigerant tank 1.

Comparative Example 3

The same method as in Example 3 was repeated except that the vapor valve 4 at the top of the refrigerant tank 1 was closed to interrupt the communication between the vapor phase of the refrigerant tank 1 and the vapor phase of the adjustor refrigerant container 6. The composition of the initial refrigerant M in the refrigerant tank 1 was verified to be as follows.

HFC32/HFC134a=30.2/69.8

As a result of the dividing and charging operation, the composition was as follows of the refrigerant in the receiver divisionally charged near the liquid phase draw percentage 95% being the draw limit of the refrigerant tank 1.

HFC32/HFC134a=28.6/71.4

The composition thus varied over the permissible range of ±1% by weight with respect to the original composition of the refrigerant in the refrigerant tank 1.

EXAMPLE 4

In FIG. 1, the refrigerant tank 1 was filled with 20 kg of the non-azeotropic mixed refrigerant R403B. Sampling the refrigerant in the refrigerant tank 1 through the liquid draw pipe 2, the composition thereof was measured by gas chromatography and the composition was verified to be as follows.

HC290/HCFC22/FC218=4.9/56.1/39

Separately, the adjustor refrigerant container 6 was filled with 100 kg of the same refrigerant R403B as above to be used as the adjustor refrigerant H. The weight of this adjustor refrigerant H was five times greater than the weight of the refrigerant M in the refrigerant tank 1. The composition of this adjustor refrigerant H was as follows.

HC290/HCFC22/FC218=5.2/55.3/39.5

It was thus verified that the composition of the adjustor refrigerant H was within the range of ±1% by weight with respect to the composition of the refrigerant in the refrigerant tank 1.

Next, as shown in FIG. 1, the top of the refrigerant tank 1 was connected through the conducting pipe 7 to the top of the adjustor refrigerant container 6 and the inside of the conducting pipe 7 was evacuated with the vapor valves 4, 8 at the top of the respective containers being closed and with the exhaust valve 10 of the side pipe being opened. After the evacuation, the exhaust valve 10 was closed and the vapor valves 4, 8 were opened to bring the vapor phase portions of the both containers into communication with each other. In this state the refrigerant was drawn through the liquid draw pipe 2 of the refrigerant tank 1, the liquid valve 3, and the flexible hose 5 to successively charge the plurality of receivers $R_1$, $R_2$, . . . , $R_n$ for dividing and charging by 0.5 kg refrigerant each.

The liquid phases were sampled from the respective receivers $R_1$, $R_2$, . . . , $R_n$ for dividing and charging and compositions of the respective samples were analyzed. The results showed almost equivalent compositions for the all receivers, and with the refrigerant in the receiver divisionally charged near the liquid-phase draw percentage 95% being the draw limit of the refrigerant tank 1, the composition thereof was within the permissible range of ±1% by weight with respect to the original composition of the refrigerant in the refrigerant tank 1.

Comparative Example 4

The same method as in Example 4 was repeated except that the vapor valve 4 at the top of the refrigerant tank 1 was closed to interrupt the communication between the vapor phase of the refrigerant tank 1 and the vapor phase of the adjustor refrigerant container 6. The composition of the refrigerant M in the refrigerant tank 1 was verified to be as follows.

HC290/HCFC22/FC218=5.1/56.2/38.7

As a result of the dividing and charging operation, the composition was as follows of the refrigerant in the receiver divisionally charged near the liquid-phase draw percentage 95% being the draw limit of the refrigerant tank 1.

HC290/HCFC22/FC218=4.7/58.3/37

The composition thus varied over the permissible range of ±1% by weight with respect to the original composition of the refrigerant in the refrigerant tank 1.

EXAMPLE 5

In FIG. 2, the refrigerant tank 21, in which the extension pipe 29 was extended so as to keep the vapor phase of the adjustor refrigerant H in direct contact with the liquid phase of refrigerant M, was charged with 20 kg of the non-azeotropic mixed refrigerant R407C. The refrigerant in the refrigerant tank 21 was sampled through the liquid draw pipe 22 at the bottom and was analyzed. The composition of the refrigerant was verified to be as follows.

HFC32/HFC125/HFC134a=23.2/24.9/51.9

Separately, the adjustor refrigerant container 26 was filled with 20 kg of the refrigerant R407C to be used as the adjustor refrigerant H. The weight of this adjustor refrigerant H was equal to the weight of the refrigerant M in the refrigerant tank 21. The composition of this adjustor refrigerant H was as follows.

HFC32/HFC125/HFC134a=24.1/25.8/50.1

It was thus verified that the composition of the adjustor refrigerant H was within the range of ±2% by weight with respect to the composition of the refrigerant in the refrigerant tank 1.

Next, as shown in FIG. 2, the vapor valves 24, 28 provided at the top of the refrigerant tank 21 and at the top of the adjustor refrigerant container 26 were connected by the conducting pipe 27 and the inside of the conducting pipe 27 was evacuated with the vapor valves 24, 28 being closed and with the exhaust valve 30 provided in the side pipe of conducting pipe 27 being opened. After the evacuation, the exhaust valve 30 was closed and the vapor valves 24, 28 were opened, thereby making the both containers communicate with each other. In this state, the refrigerant was drawn through the liquid draw pipe 22 of the refrigerant tank 21 and the liquid valve 23 to successively charge the plural receivers for dividing and charging by 0.5 kg refrigerant each.

The liquid phases were sampled from the respective receivers for dividing and charging and the components thereof were analyzed. The results showed that R407C was able to be charged into the plural receivers for dividing and charging within the permissible range of ±1% by weight with respect to the original composition of the refrigerant in the refrigerant tank 1 up to the draw limit of the refrigerant tank 21.

The method for dividing and charging of non-azeotropic mixed refrigerant according to the present invention comprises performing the dividing and charging operation while maintaining the vapor phase or the liquid phase of the refrigerant in the refrigerant tank in communication with the vapor phase of the adjustor refrigerant having the composition substantially equivalent to that of the refrigerant in the refrigerant tank, so that the compositions of divided refrigerant portions can be maintained almost constant up to the draw limit of the refrigerant in the refrigerant tank.

What is claimed is:

1. A method for dividing and charging of a non-azeotropic mixed refrigerant filled in at least one refrigerant tank, comprising:

a step of successively dividing and charging the non-azeotropic mixed refrigerant filled in said refrigerant tank into a plurality of receivers while maintaining a vapor phase or a liquid phase of the refrigerant in said refrigerant tank in communication with a vapor phase of an adjustor refrigerant in at least one adjustor refrigerant container filled with the adjustor refrigerant having a composition substantially equivalent to a composition of the non-azeotropic mixed refrigerant.

2. A method according to claim 1, wherein the total weight of said adjustor refrigerant is equal to or greater than the total weight of the refrigerant in said refrigerant tank.

3. A method according to claim 1, wherein the refrigerant in said refrigerant tank is a non-azeotropic mixed refrigerant containing two or more selected from the group consisting of hydrochlorofluorocarbons, hydrofluorocarbons, hydrocarbons, fluorocarbons, hydrofluoroethers, fluoroethers, and fluoroiodocarbons.

4. A method according to claim 1, wherein the refrigerant in said refrigerant tank is a non-azeotropic mixed refrigerant containing two or more selected from the group consisting of difluoromethane, pentafluoroethane, and 1,1,1,2-tetrafluoroethane.

5. A method according to claim 1, wherein the composition of said adjustor refrigerant is within a range of ±2% by weight with respect to the composition of the non-azeotropic mixed refrigerant filled in said refrigerant tank.

6. A method according to claim 1, further comprising:

a step of preparing the refrigerant tank filled with said non-azeotropic mixed refrigerant;

a step of preparing the adjustor refrigerant container filled with said adjustor refrigerant; and a step of connecting said refrigerant tank with said adjustor refrigerant container through a conducting pipe, thereby maintaining the vapor phase of the adjustor refrigerant in said adjustor refrigerant container in communication with the vapor phase or the liquid phase of the non-azeotropic mixed refrigerant in said refrigerant tank.

7. A method according to claim 1, wherein in the step of dividing and charging said non-azeotropic mixed refrigerant, the vapor phase of said adjustor refrigerant is maintained in a state of being capable of being introduced into the vapor phase or into the liquid phase of the non-azeotropic mixed refrigerant with progress of discharge of the refrigerant in said refrigerant tank.

8. A method according to claim 1, wherein in the step of dividing and charging said non-azeotropic mixed refrigerant, a temperature of said adjustor refrigerant is maintained within a range of between a temperature of the non-azeotropic mixed refrigerant in the refrigerant tank and said temperature +5° C.

9. A method according to claim 1, wherein in the step of dividing and charging said non-azeotropic mixed refrigerant, a change in a temperature of the non-azeotropic mixed refrigerant in said refrigerant tank is maintained within a range of an initial temperature thereof ±10° C.

* * * * *